US008670702B2

(12) United States Patent
Ikegami et al.

(10) Patent No.: US 8,670,702 B2
(45) Date of Patent: Mar. 11, 2014

(54) IMAGE FORMING APPARATUS

(75) Inventors: Shoichiro Ikegami, Yokohama (JP); Akihito Kanamori, Yokohama (JP); Atsutoshi Ando, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 149 days.

(21) Appl. No.: 13/246,105

(22) Filed: Sep. 27, 2011

(65) Prior Publication Data

US 2012/0076555 A1 Mar. 29, 2012

(30) Foreign Application Priority Data

Sep. 28, 2010 (JP) ..... 2010-217069

(51) Int. Cl.
*G03G 15/20* (2006.01)

(52) U.S. Cl.
USPC ..... 399/333

(58) Field of Classification Search
USPC ..... 399/328, 330, 320, 333
See application file for complete search history.

(56) References Cited

U.S. PATENT DOCUMENTS

| | | | |
|---|---|---|---|
| 5,570,171 | A | 10/1996 | Kusumoto et al. |
| 6,083,588 | A | 7/2000 | Kagawa et al. |
| 6,542,712 | B2 | 4/2003 | Kamijo et al. |
| 6,684,050 | B2 | 1/2004 | Kiuchi |
| 7,177,579 | B2 | 2/2007 | Uchida et al. |
| 7,209,696 | B2 | 4/2007 | Umezawa et al. |
| 7,215,899 | B2 | 5/2007 | Kimizuka et al. |
| 7,251,447 | B2 | 7/2007 | Kanamori et al. |
| 7,406,287 | B2 | 7/2008 | Matsumoto et al. |
| 7,428,390 | B2 | 9/2008 | Ando |
| 7,512,370 | B2 | 3/2009 | Shimizu et al. |
| 7,570,895 | B2 | 8/2009 | Ando et al. |
| 7,792,448 | B2 | 9/2010 | Ando et al. |
| 2002/0061211 | A1 | 5/2002 | Kamijo et al. |
| 2003/0016974 | A1 | 1/2003 | Kiuchi |
| 2007/0196145 | A1 | 8/2007 | Matsumoto et al. |
| 2011/0100972 | A1 | 5/2011 | Ikegami et al. |
| 2012/0027479 | A1 | 2/2012 | Uekawa et al. |
| 2012/0063823 | A1 | 3/2012 | Ando et al. |

FOREIGN PATENT DOCUMENTS

| | | | |
|---|---|---|---|
| JP | 7-271225 | | 10/1995 |
| JP | 8-110721 | | 4/1996 |
| JP | 8-241000 | | 9/1996 |
| JP | 2002-82551 | | 3/2002 |
| JP | 2006133430 | A * | 5/2006 |
| JP | 2007-219401 | | 8/2007 |
| JP | 2008-20789 | | 1/2008 |

OTHER PUBLICATIONS

Machine translation of Kato et al., JP 2008-020789.*
Machine translation of Ishhiki et al., 2006-133430.*
Machine translation of Kato et al., JP 2008-020789 (2008).*
Machine translation of Ishhiki et al., 2006-133430 (2006).*
U.S. Appl. No. 13/190,759, Eiji Uekawa, Akihito Kanamori, Yusuke Jota, filed Jul. 26, 2011.
U.S. Appl. No. 13/232,596, Atsutoshi Ando, Shoichiro Ikegami, filed Sep. 14, 2011.

* cited by examiner

*Primary Examiner* — David Gray
*Assistant Examiner* — Sevan A Aydin
(74) *Attorney, Agent, or Firm* — Fitzpatrick, Cella, Harper & Scinto

(57) ABSTRACT

An image heating apparatus includes a heating rotatable member; a pad-like pressing member contacted to the heating rotatable member and cooperating with the heating rotatable member to provide a nip for nipping and feeding a recording material, wherein the pressing member includes a base material having a roughened surface and a parting layer on the roughened surface, the parting layer being contacted to the heating rotatable member.

3 Claims, 6 Drawing Sheets

(a)

(b)

IMAGE FORMING APPARATUS

FIELD OF THE INVENTION AND RELATED ART

The present invention relates to an image heating device used by an image forming apparatus such as a copying machine, a laser beam printer, etc., which uses an electrophotographic image formation process, an electrostatic recording process, or the like image formation process.

There are various image heating apparatuses, for example, a fixing device for heating an unfixed toner image on a sheet of recording medium in order to fix the toner image to the sheet, and a glossing device for heating a fixed image on a sheet of recording medium in order to increase the image in gloss.

There are various types of image heating devices mountable as a fixing device in an electrophotographic copying machine or printer. One type of such an image heating device has: a fixation roller; a heating means for externally heating the fixation roller; and a pressure roller to be placed in contact with the fixation roller to form a nip. An image heating device of this type fixes an unfixed toner image on a sheet of recording medium to the sheet, by heating the toner image while conveying the sheet through its fixation nip, with the sheet being kept pinched by the fixation nip. Further, there have been proposed a fixing device of such a type that heats the peripheral surface of a fixation roller with the use of a ceramic heater, and a fixing apparatus of such a type that heats the peripheral surface of a fixation roller with the use of a cylindrical heat roller which is relatively small in diameter and has a halogen heater in its hollow.

These types of fixing device externally heat the peripheral surface of a fixation roller, with the use of a ceramic heater, or a heat roller which is small in diameter and internally holds a halogen heater. Therefore, they can quickly increase in temperature the peripheral surface of the fixation roller, being therefore beneficial in that they can reduce a fixation roller in the length of time necessary to warm (heat) the fixation roller, more specifically, increase the temperature of the fixation roller from the ambient temperature to the fixation temperature (target temperature) for fixing an unfixed toner image, when a copying machine or a printer is started up.

A fixation roller employed by a fixing device which externally heats the peripheral surface of its fixation roller is made up of a central shaft, an adiabatic elastic layer, a thermally conductive layer, and a parting layer. The adiabatic elastic layer is formed of plain or foamed silicon rubber, which is low in thermal conductivity, and covers the peripheral surface of the center shaft. The thermally conductive layer is formed of silicone rubber or metallic substance which is high in thermal conductivity, and covers the peripheral surface of the adiabatic elastic layer. The parting layer is formed of fluorinated resin, and covers the peripheral surface of the thermally conductive layer.

The fixing device described above has an elastic fixation roller, being therefore capable of embracing the thermally softened toner particles on a sheet of recording medium, with its elastic fixation roller. Therefore, it can enable an image forming apparatus to form a high quality image, more specifically, an image which is free of the nonuniformity attributable to fixation errors. Further, the fixing device described above is structured to direct heat to the peripheral surface of its fixation roller, and is provided with an adiabatic layer, which is under the surface layer. Therefore, it can quickly increases in temperature the peripheral surface of the fixation roller.

In comparison to these fixing devices described above, there are fixing devices which employ a stationary pressure applying member instead of a rotatable fixation roller. One of the fixing devices, which employs a stationary pressure applying member, is proposed in Japanese Laid-open Patent Application 2008-20789. According to this patent application, a stationary pressure applying member, which is small in thermal capacity is employed in place of the aforementioned rotatable pressure roller to reduce a fixing device in the heat loss attributable to the heat radiation from a pressure applying member into the ambient air. This setup can further reduce the length of time necessary to warm up a fixing device, and also, the amount of the energy consumption by a fixing device.

More concretely, in the case of the fixing device disclosed in the abovementioned Japanese patent application, the fixing device feeds a sheet of recording medium, on which an unfixed toner image is present, into its fixation nip, and conveys the sheet through the nip by rotating the fixation roller, that is, a rotational heating member, while keeping it in contact with the stationary pressure applying member so that the sheet slides on (rubs) the stationary pressure applying member. Therefore, it has been known that in order to ensure that a sheet of recording medium is reliably conveyed through the fixation nip, the surface of the stationary pressure applying member is small in the amount of the friction between itself and the peripheral surface of a fixation roller, and also, between itself and a sheet of recording medium. Further, it has also been known that since the surface of the pressure applying member comes into contact with the toner particles on a sheet of recording medium and/or the toner particles on the fixation roller, the surface properties of the pressure applying member are such that toner particles are unlikely to adhere to the surface.

Using a resinous substance which contains fluorinated resin, such as PEEK and PFA, which is low in frictional resistance and repels toner particles, as the material for the parting layer, that is, the surface layer, of a pressure applying member can make a fixing device reliably convey a sheet of recording medium, and also, can prevent toner particles and the like particles from adhering to the pressure applying member. This solution, however, is problematic for the following reason: As a fixing device increases in the cumulative number of sheets of recording medium conveyed through the fixing device while sliding on (rubbing) the pressure applying member, the parting layer of the pressure applying member, which is formed of a resinous substance, is frictionally worn by the calcium carbonate and the like contained in a sheet of recording medium. In some cases, the parting layer is completely worn away, exposing thereby the substrate and/or layer of adhesive of the pressure applying member. With the substrate and/or layer of adhesive of the pressure applying member being exposed, the pressure applying member increases in the amount of friction between itself and a fixation roller, and also, the amount of friction between itself and a sheet of recording medium, which in turn makes it difficult for a fixing device to properly convey a sheet of recording medium through its fixing nip.

SUMMARY OF THE INVENTION

The present invention is an improvement upon the conventional technologies regarding a fixing device, and its primary object is to provide an image heating device which is unlikely to suffer from the problem that as a fixing device increases in the cumulative number of sheets of recording medium conveyed through it, it reduces in recording medium conveyance performance.

According to an aspect of the present invention, there is provided an image heating apparatus comprising a heating rotatable member; a pad-like pressing member contacted to said heating rotatable member and cooperating with said heating rotatable member to provide a nip for nipping and feeding a recording material, wherein said pressing member includes a base material having a roughened surface and a parting layer on the roughened surface, the parting layer being contacted to said heating rotatable member.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Hereinafter, the preferred embodiments of the present invention are described with reference to the appended drawings, in which the corresponding components, their portions, etc., of the image forming apparatuses are given the same referential code.

<<Embodiment 1>>

(Image Forming Apparatus)

Figure 11:
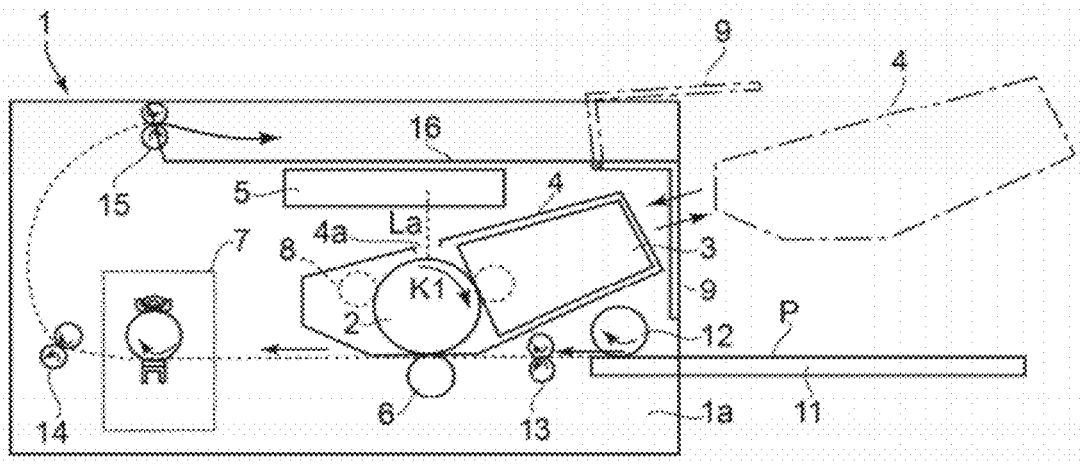
FIG. 11 is a schematic sectional view of a typical image forming apparatus in which an image heating device in accordance with the present invention is mountable as its fixing device. It shows the general structure of the apparatus.

FIG. 11 is a schematic sectional view of a typical image forming apparatus having an image heating device (fixing device) in accordance with the present invention. It shows the general structure of the apparatus. This image forming apparatus is an electrophotographic laser beam printer.

The printer 1 in this embodiment receives the information of the image to be formed, from an apparatus (unshown), such as a host computer, which is outside the external shell of the main assembly 1*a* of the printer 1 (main assembly 1*a* of image forming apparatus) and is capable of providing the printer 1 with the information of the image to be formed. The printer 1 carries out one of the known electrophotographic image formation processes to record an image on a sheet P of recording medium, based on the received information of the image to be formed.

The printer 1 employs a process cartridge 4. The process cartridge 4 has: an electrophotographic photosensitive member 2, as an image bearing member, which is in the form of a drum; a primary charging system 8; and a developing device 3. The printer 1 has also a laser scanner unit 5. The laser scanner unit 5 forms on the peripheral surface of the photosensitive drum 2, an electrostatic latent image which reflects the information of the image to be formed. As described above, the information of the image to be formed, which hereafter will be referred to simply as "image information" is provided by the aforementioned image information providing apparatus. Further, the printer 1 has a transfer member 6 and a fixing device 7. The transfer member 6 is for transferring an image onto the sheet P of recording medium. The fixing device 7 is an image heating device which is for fixing an unfixed image on the sheet P of recording medium to the sheet P by the application of heat and pressure to the sheet P and the image thereon.

The cartridge 4 is removably mountable in the printer main assembly 1*a*. More specifically, the printer 1 is structured so that when it is necessary to carry out maintenance operations, such as repairing the photosensitive drum 2 or supplying the developing device 3 with developer, it can be simply and quickly maintained by opening the cover 9 of the printer main assembly 1*a*, which is attached to the printer main assembly 1*a* so that it can be opened or closed, and replacing the cartridge 4 in the printer main assembly 1*a*, which contains the components to be repaired and/or maintained, with a replacement cartridge (repaired or brand new cartridge).

The primary charging system 8 is designed so that as a preset bias is applied to the system 8 from a commercial electrical power source or the like before the peripheral surface of the photosensitive drum 2 is exposed by the scanner unit 5 while the photosensitive drum 2 is rotated, it uniformly charges the peripheral surface of the photosensitive drum 2 to a preset potential level.

The scanner unit 5 outputs a beam La of laser light while modulating the beam La with sequential electrical digital picture element signals which are provided by the aforementioned image information providing apparatus and reflect the information of the image to be formed. The outputted beam La of laser light scans (exposes) the charged area of the peripheral surface of the photosensitive drum 2, through a window 4*a* with which the frame (unshown) of the cartridge 4 is provided. As a result, an electrostatic latent image, which reflects the "image information", is effected on the peripheral surface of the photosensitive drum 2.

Next, the image formation sequence carried out by the printer 1 is described. As the start button (unshown) of the printer main assembly 1*a* is pressed, or the like action is taken, the photosensitive drum 2 begins to be rotated in the clockwise direction indicated by an arrow mark K1 at a preset peripheral velocity. At the same time as the photosensitive drum 2 begins to be rotated, the peripheral surface of the photosensitive drum 2 begins to be uniformly charged to preset polarity and potential level by the primary charging system 8 to which a preset bias is being applied.

Next, the uniformly charged area of the peripheral surface of the photosensitive drum 2 is scanned (exposed) by the scanner unit 5 according to the image information received from the image information providing apparatus. As a result, an electrophotographic latent image, which reflects the image information, is effected on the uniformly charged area of the peripheral surface of the photosensitive drum 2. This electrostatic latent image is developed with the developer in the developing device 3, into a visible image, that is, an image formed of toner, which hereafter may be referred to as "toner image".

Meanwhile, a sheet conveyance roller 12 is driven with a preset timing, whereby a sheet P of recording medium is fed into the printer main assembly 1*a* from a sheet feeder cassette 11 while being separated from the rest of the sheets P in the cassette 11. The sheet feeder cassette 11 is capable of storing in layers multiple sheets P of recording medium. It is removably mountable in the printer main assembly 1*a*. After being fed into the printer main assembly 1*a* from the sheet feeder cassette 11, the sheet P of recording medium is sent to a pair of registration rollers 13, and is temporarily held there. Then, it is released with a preset timing by the pair of registration rollers 13 to be conveyed to the transfer nip, that is, the nip formed between the peripheral surface of the photosensitive drum 2 and image transferring member 6. Then, it is conveyed through the transfer nip while remaining pinched between the photosensitive drum 2 and image transferring member 6. It is while the sheet P is conveyed through the transfer nip that the toner image on the photosensitive drum 2 is transferred onto the sheet P by the image transferring member 6 as if it is peeled away from the photosensitive drum 2.

After the transfer of the toner image onto the sheet P of recording medium, the toner image (unfixed) is thermally fixed to the sheet P by the fixing device 7. Then, the sheet P is conveyed further by a pair of rollers 14 which are rotatably supported by the printer main assembly 1*a*, and then, is discharged from the printer apparatus main assembly 1*a* by a pair of discharge rollers 15, into a delivery tray 16 in such a manner that it is layered on the sheets P in the tray 16. The delivery tray 16 is an integral part of the top wall of the printer main assembly la. The discharging of the sheet P into the delivery tray 16 concludes the image formation sequence.

(Image Heating Device)

Figure 1:
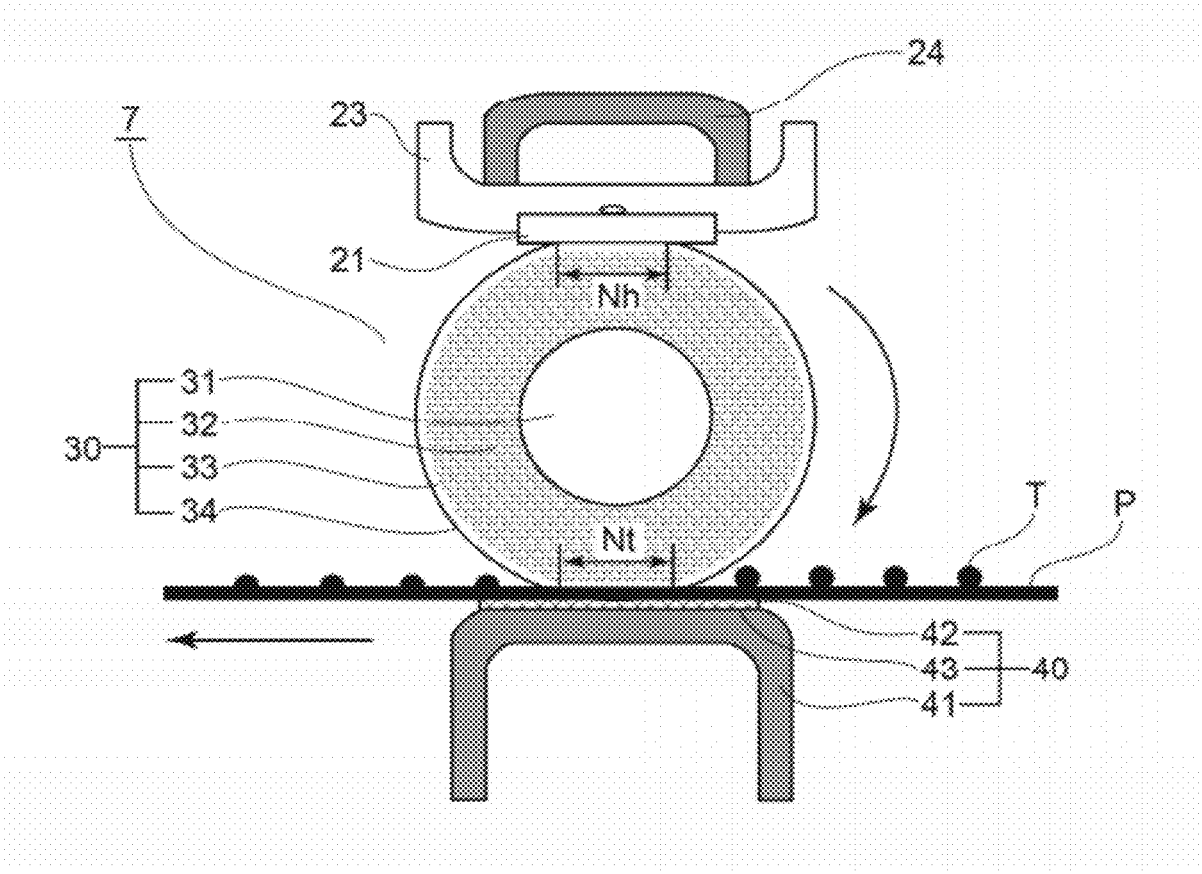
FIG. 1 is a schematic sectional view of the fixing device in the first preferred embodiment of the present invention, at a vertical plane perpendicular to the recording medium conveyance direction of the device, and shows the general structure of the device.
Figure 2:
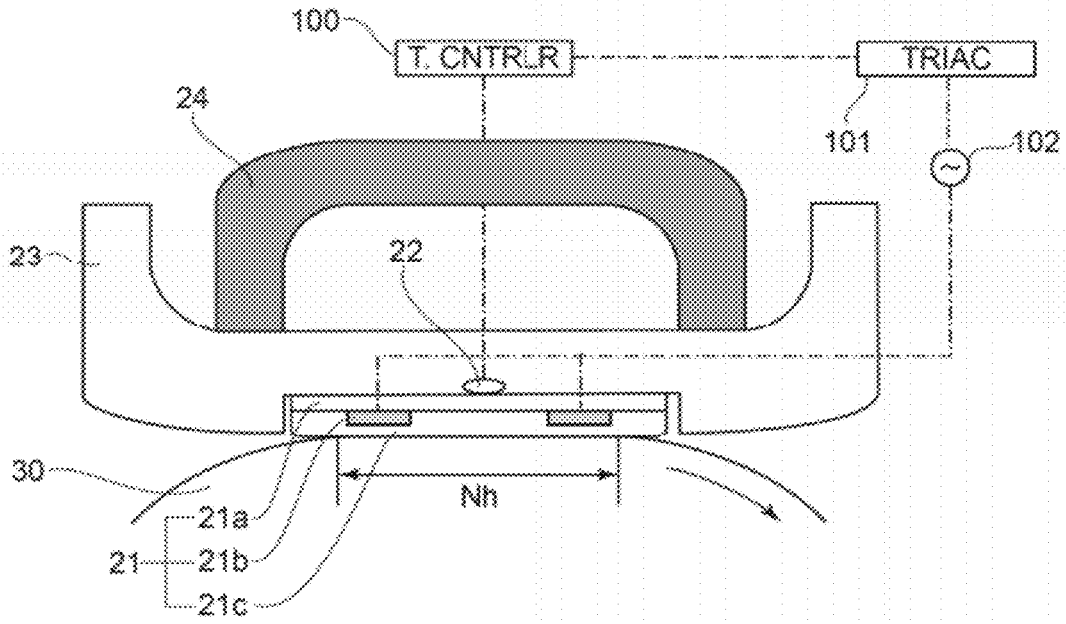
FIG. 2 is a schematic sectional view of the combination of the heating nip, adjacencies of the heating nip, and temperature control system in the first preferred embodiment.
Figure 3:
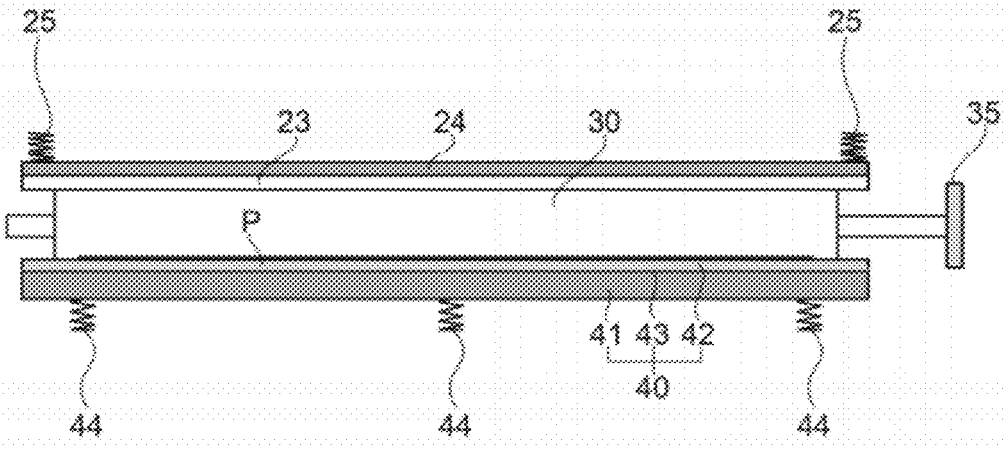
FIG. 3 is a schematic sectional view of the fixing device in the first embodiment, at a vertical plane parallel to the lengthwise direction of the fixing device, and shows the general structure of the device.

Next, referring to FIGS. 1-3, the fixing device 7 which is an image heating device in accordance with the present invention is described. Designated by a referential numeral 30 is a fixation roller as a rotatable heating member. Designated by a referential numeral 21 is a heater as a heating means (heat source) for externally heating the fixation roller 30. Designated by a referential numeral 23 is a heater holder as a member for holding the heater 21. Designated by a referential numeral 24 is a stationary pressure applying member (backup member), which opposes the fixation roller 30 which is a rotational heating member. The fixation roller 30, and the pressure applying member 24 which is on the heater side, form a heating nip Nh.

The fixation roller 30 and stationary pressure applying member 40 form a fixation nip Nt, through which a sheet P of recording member, on which an unfixed toner image formed of toner T is present, is conveyed so that the unfixed toner image is fixed to the sheet P.

These components of the image heating device described above are long and narrow, and their lengthwise direction is parallel to the lengthwise direction of the image heating device (direction perpendicular to recording medium conveyance direction).

The fixation roller 30 of the fixing device 7 in this embodiment does not have an internal heat source. That is, the fixing device 7 is different from a fixing device of the so-called heat roller type, which employs as a fixation roller, a heat roller which has a heat source, such as a halogen lamp and the like, in its metallic roller as its substrate. Therefore, the fixation roller 30 can be reduced in thermal capacity by reducing it in external diameter.

The heating nip Nh and fixation nip Nt are different in their position on the peripheral surface of the fixation roller 30 in terms of the rotational direction of the fixation roller 30. The shorter the distance between the heating nip Nh and fixation nip Nt, the less the heat radiation into the ambient air, and also, less the amount by which heat escapes inward of the fixation roller 30, and therefore, the more efficiently the heat from the heating nip Nh is conveyed to the fixation nip Nt by the surface layer of the fixation roller 30. In consideration of this fact and the like, a roller which is in a range of 10-20 mm in external diameter is employed as the fixation roller 30 in this embodiment. Further, the pressure applying member in this embodiment is simpler in structure. The employment of the pressure applying member 40 in this embodiment can simplify a fixing device in general structure, and can reduce the fixing device in size and thermal capacity.

As described above, the fixing device 7 in this embodiment is structured to be suitable for reducing the device 7 in the length of time necessary for the device 7 to be warmed up, and also, energy consumption.

a) Fixation Roller 30

The fixation roller 30 comprises a metallic core 31, an adiabatic elastic layer 32, at least one thermally conductive layer 33, and a parting layer 34. The material for the metallic core 31 is aluminum, iron, SUS (stainless steel) SUM (free-cutting steel: easily machinable steel), or the like. The adiabatic elastic layer 32 is formed of a substance which is low in thermal conductivity. It covers the entirety of the peripheral surface of the metallic core 31. The thermally conductive layer 33 covers the peripheral surface of the elastic layer 32. The metallic core 31 is thermally insulated from the peripheral surface of the fixation roller 30 by the adiabatic elastic layer 32 which covers the entirety of the peripheral surface of the metallic core 31. Therefore, even if it is low in thermal conductivity and thermal capacity, its effect upon the surface temperature of the fixation roller 30 is little. Therefore, it does not matter whether the metallic core 31 is solid or hollow.

The material for the adiabatic elastic layer 32 is balloon rubber, sponge rubber, or the like, for example. Balloon rubber is a mixture of silicone rubber and hollow filler (such as micro balloons). Sponge rubber is formed by causing silicon rubber to foam with the use of hydrogen. Further, the material for the adiabatic elastic layer 32 may be silicon rubber which contains water-absorbent polymer. Moreover, it may be a solid rubber which is low in thermal conductivity.

As the material for the thermally conductive layer 33, a highly thermally conductive substance made by mixing highly thermally conductive filler into silicon rubber or fluorinated rubber is preferable because it can store a certain amount of heat, and therefore, can reliably provide a sheet P of recording medium with heat. The parting layer 34 is formed of a mixture of fluorinated resin and filler, for example. It is required not only to repel toner, but also, to be frictional enough to generate friction large enough to convey the sheet P. The fixation roller 30 may be structured so that the parting layer 34 doubles as the highly thermally conductive layer 33. The fixation roller 30 is rotatably supported by the frame of the fixing device 7, with the presence of a pair of bearings between the lengthwise ends of its metallic core 31, and the frame, one for one.

b) Heater 21

Referring to FIG. 2, the heater 21 has a substrate 21*a* and a layer 21*b* of heat generating resistor. The substrate 21*a* is long and narrow, and its lengthwise direction is perpendicular to the recording medium conveyance direction. It is formed of dielectric ceramic (such as alumina and aluminum nitrate), or heat resistant resin (such as polyimide, PPS, and liquid polymer). The layer 21*b* of heat generating resistor is formed of an electrically conductive substance, such as Ag/Pd (silver-palladium), $RuO_2$, $Ta_2N$, on one of the surfaces of the substrate 21*a*, with a method such as screen printing. It also is in the form of a piece of wire, or long and narrow strip. It extends in the lengthwise direction of the substrate 21*a*. It is roughly 10 μm in thickness, and 1-5 mm in width. Further, the heater 21 has a dielectric protective layer 21*c* which covers the entirety of the surface of the layer 21*b* of heat generating resistor to protect and insulate the layer 21*b*. The dielectric protective layer 21*c* is formed of a dielectric substance such as glass, polyimide, or the like. The thickness of the protective layer 21*c* is in a range of 10 μm-100 μm.

Further, the heater 21 may be provided with a parting layer (unshown), as a surface layer, which covers the entirety of the dielectric protective layer 21*b*, not only to reduce the friction between the heater 21 and the peripheral surface of the fixation roller 30, but also, to prevent the unfixed toner on the sheet P of recording medium, from adhering to the heater 21. The material for the parting layer is fluorinated resin or the like, which is excellent in terms of slipperiness and nonadhesiveness. However, the protective layer 21*c* may be formed of fluorinated resin or the like, directly on the layer 21*b* of heat generating resistor to a thickness in a range of 10 μm-100 μm, so that the protective layer 21*c* doubles as the parting layer.

The heater 21 is held by the holder 23 by its substrate 21*a* in such an attitude that its protective layer 21*c* faces the peripheral surface of the fixation roller 30. The holder 23 is formed of heat resistant resin such as liquid polymer, phenol resin, PPS, and PEEK. The lower the holder 23 in thermal conductivity, the higher it is in thermal efficiency in terms of the heating of the fixation roller 30. Thus, the material for the holder 23 may contain hollow filler such as glass balloon, silica balloon, etc.

The lengthwise ends of the holder 23 are in engagement with a fixation stay 24 held by the fixing device frame. Further, the holder 23 is under the pressure from a pair of compression springs 25 as pressure applying means which press on the lengthwise end portions of the holder 23. Thus, the holder 23 remains pressed toward the fixation roller 30, as shown in FIG. 3. The fixation stay 24 is required to uniformly transmit the pressure which it receives by its lengthwise end portions, to the holder 23, across the entirety of the holder 23 in terms of the lengthwise direction of the holder 23. Therefore, it is formed of a rigid substance such as iron, stainless steel, SUM, zinc-plated steel plate, or the like. Further, in order to provide the holder 23 with rigidity, it is shaped so that its cross section is U-shaped. Therefore, the holder 23 is unlikely to be deformed (bent) by the pressure applied by the pair of compression springs. Therefore, the heating nip Nh which is formed between the surface of the protective layer 21*c* of the heater 21 and the peripheral surface of the fixation roller 30, because of the deformation of the elastic layer of the fixation roller 30, as the heater 21 is pressed toward the fixation roller 30 by the pressure applied to the heater 21 through the holder 23, is roughly uniform in width in terms of the recording medium conveyance direction.

In the case of this embodiment, the surface of the substrate 21*a* of the heater 21, on which the layer 21*b* of heat generating resistor is present, faces the peripheral surface of the fixation roller 30. However, in a case where aluminum nitride or the like, which is excellent in thermal conductivity, is used as the material for the substrate 21*a*, the layer 21*b* of heat generating resistor may be formed on the opposite surface of the substrate 21*a* from the fixation roller 30. In such a case, the protective layer 21*c* is formed on the opposite surface of the substrate 21*a* from the fixation roller 30, and the slippery layer is formed on the surface of the substrate 21*a*, which faces the fixation roller 30.

The substrate 21*a* of the heater 21 may be curved so that its curvature matches the curvature of the peripheral surface of the fixation roller 30. With the substrates 21*a* being curved as described above, it is easier for the heater 21 to conform in shape to the peripheral surface of the fixation roller 30, and therefore, it takes less pressure for the heater 21 in this embodiment to form a nip Nh as wide as a nip Nh formed by a heater whose substrate is flat. Further, if the amount pressure applied to the heater 21 in this embodiment to form a nip Nh is the same as that applied to a heater with a flat substrate, the heater 21 in this embodiment can form a nip Nh wider than a nip Nh formed by the heater with a flat substrate.

c) Pressure Applying Stationary Member 40

Figure 5:
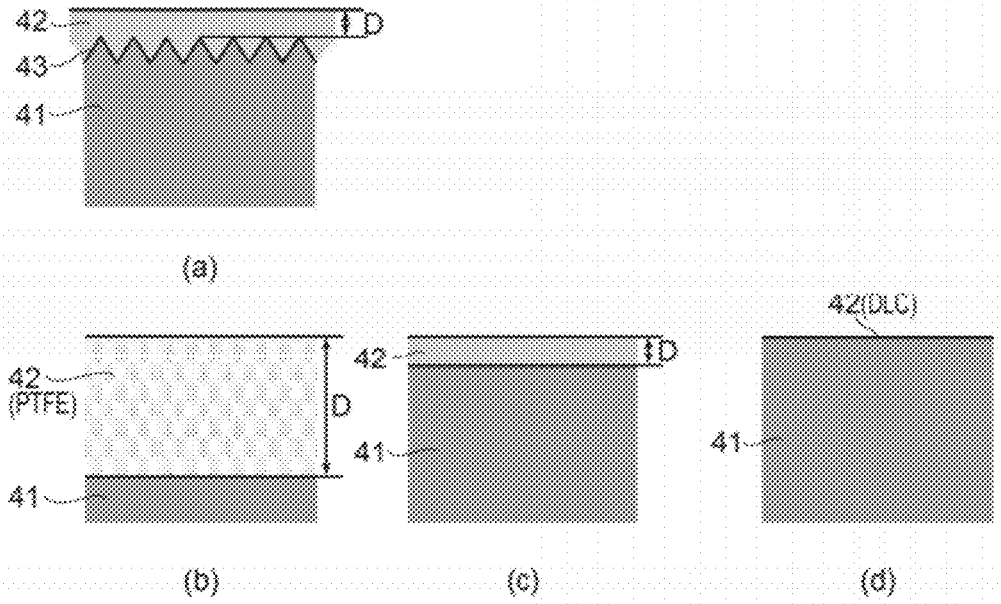
FIG. 5(*a*) is a schematic sectional view of the fixation pad in the first embodiment, the substrate of which was roughened across the surface on which its parting layer was formed, and FIGS. 5(*b*), 5(*c*), and 5(*d*) are sectional views of the comparative fixation pads, the substrates of which were not roughened across their surface on which their parting layer was formed, and which are different in the thickness of their parting layer, respectively.

Referring to FIG. 5(*a*), the pressure applying stationary member 40, which is in the form of a pad (fixation pad) is solidly attached to the fixing device frame. It is made up of a substrate 41 (having rough surface), and a parting layer 42. The substrate 41 is long and narrow, and its lengthwise direction is parallel to the lengthwise direction of the fixing device 7. The parting layer 42 is on the surface of the substrate 41, which faces the fixation roller 30. This pressure applying member 40 is positioned so that the surface of its parting layer 42 is perpendicular to the line which connects the center of the pressure applying member 40 in terms of the recording medium conveyance direction, and the axial line of the fixation roller 30. Further, it is held to the fixing device frame by the lengthwise end portions of its substrate 41, and remains pressured toward the fixation roller 30 by the pressure applied by a pair of compression springs 44 (FIG. 3) as pressure applying means. Therefore, the pressure applying member 40 remains pressed upon the peripheral surface of the fixation roller 30. Thus, the elastic layer of the fixation roller 30 remains deformed. Therefore, the fixation nip Nt with a preset width is provided between the pressure applying member 40 and the peripheral surface of the fixation roller 30.

c-1) Parting Layer 42

Referring to FIG. 5(*a*), the parting layer 42 is D in thickness, and is on the substrate 41. The material for the parting layer 42 is desired to be low in friction so that it does not impede the conveyance of the sheet P of recording medium, and also, to be nonadhesive so that the contaminants, such as the toner particles having transferred to the fixation roller 30 from the sheet P, do not adhere to the parting layer 42. Further, it is desired to be adhesive enough to remain adhered to the roughened surface of the substrate 41. Therefore, a resinous substance such as PEEK (polyether-ether-ketone), PTFE (polytetrafluoroethylene), FEP, PFE, PAI (polyamide-imide), PI (polyimide), and a mixture of the preceding resinous substances, is used as the material for the parting layer 42. In this embodiment, a mixture of PEEK and PFA was used as the material for the parting layer 42.

The ratio of the area which the parting layer 42 occupies in the fixation nip Nt, relative to the fixation nip Nt, is desired to be no less than 40%, regardless of the method used to roughen the surface 43 of the substrate 41, and the shape of each of the peaks and valleys of the roughened surface 43. This subject is described later in detail.

c-2) Substrate 41

The substrate 41 is desired to be highly resistant to the frictional wear attributable to the friction between itself and the sheet P of recording medium, and also, the friction between itself and fixation roller 30. Thus, the material for the substrate 41 is desired to be a metallic substance, such as iron, stainless steel, SUM, zinc-plated steel plate, and the like.

c-3) Profile of Roughened Surface 43

The surface 43 of the substrate 41 is roughened with the use of one of the known surface-roughening methods. That is, the surface (43) of the substrate 41, which is going to face the parting layer 42, is intentionally roughened. More specifically, the surface (43) is roughened by such a method as blasting, chemical processing, grinding (belt grinding, etc.), although the method for roughening the surface (43) does not need to be limited to one of these methods. Further, the roughened surface 43 may be strengthened (hardened) by carburizing, nitriding, quenching, or the like method. In this embodiment, the substrate 41 was made of zinc-plated steel plate. Then, its superficial oxide film was thermally reduced. Then, the surface (43) was roughened by blasting.

d) Compression Springs 25 and 44

As described above, multiple compression springs 25, shown in FIG. 3, press on the center and lengthwise end portions of the fixation stay 24. Thus, the holder 23 is kept pressed toward the fixation roller 30.

More specifically, there are a total of three compression springs, which are at the lengthwise ends, and the center, of the pressing member 40 in terms of the lengthwise direction of the pressing member 40, one for one. The springs 44 press the pressing member 40 on the fixation roller 30 without causing the pressing member to deform. Therefore, the fixation nip Nt is formed roughly uniform in width in terms of its lengthwise direction.

(Thermal Fixation by Fixing Device)

Referring to FIG. 1, as a gear 35 (FIG. 3) attached to one of the lengthwise ends of the metallic core 31 is driven by a rotational driving system (unshown), the fixation roller 30 rotates in the direction indicated by an arrow mark. While the fixation roller 30 rotates, a temperature control portion 100, shown in FIG. 2, which is a temperature controlling means, turns on a triac 101 as a current controlling means. Thus, electrical current begins to flow through the layer 21*b* of heat generating resistor through a pair of electrodes (unshown), with which the lengthwise ends of the substrate 21*a* of the heater 21 are provided one for one, from an AC power source 102. As electrical current is flowed through the layer 21*b* of heat generating resistor, the layer 21*b* generates heat, causing thereby the heater 21 to increase in temperature in proportion to the amount of the heat generated by the heat generating layer 21*b*. Since the heater 21 itself is low in thermal capacity as described above, it quickly increases in temperature.

As the heater 21 increases in temperature, its temperature is detected by a temperature detecting means 22 (FIG. 2) such as a thermistor which is on the opposite surface of the substrate 21*a* from the fixation roller 30. The signal outputted from the temperature detecting means 22 is picked up by the temperature control portion 100, and is used by the control portion 100 to maintain the temperature of the heater 21 at a preset level by turning on or off the triac 101 to control the amount by which electrical current is supplied to the layer 21*b* of heat generating resistor. Thus, the peripheral surface of the fixation roller 30, which is being rotated, is heated by the heat from the heater 21. Therefore, the temperature of the peripheral surface of the fixation roller 30 is kept in a range in which the toner on a sheet P of recording medium melts to be properly fixed to the sheet P.

Incidentally, the structural arrangement for controlling the temperature of the heater 21 may be different from the one described above. For example, it may be such that the temperature of the peripheral surface of the fixation roller 30 is detected by a temperature detecting means (unshown), and the temperature of the peripheral surface of the fixation roller 30 is kept in a proper range by turning on or off the triac 101 in response to the detected temperature of the peripheral surface of the fixation roller 30 to control the amount by which electric current is supplied to the heat generating layer 21*b*.

Since the temperature of the heater 21 is controlled to keep the temperature of the peripheral surface of the fixation roller 30 in a proper range for fixation as described above, not only can the fixing device be kept stable in its image fixation performance, but also, it can be prevented from causing such a problem as "hot offset", which is the phenomenon that as an excessive amount of heat is given to a sheet P of recording medium, the toner on the sheet P is offset to the fixation roller 30.

While the temperature of the peripheral surface of the fixation roller 30 is kept in a proper range for fixation, a sheet P of recording medium, on which an unfixed toner image T is present, is introduced into the fixation nip Nt while being kept in contact with the parting layer 42 of the pressing member 40. Then, the sheet P is conveyed through the fixation nip Nt while remaining pinched between the peripheral surface of the fixation roller 30 and the parting layer 42 of the pressing member 40. While the sheet P is conveyed through the fixation nip Nt, the unfixed toner image T on the sheet P is fixed to the sheet P by the heat from the fixation roller 30. As described above, the pressing member 40 is low in thermal capacity. Therefore, the heat from the fixation roller 30 quickly transfers onto the sheet P, making it possible for the unfixed toner image T on the sheet P to be fixed to the sheet P even though the length of time a given area of the sheet P remains in contact with the peripheral surface of the fixation roller 30 is relatively short.

(Function and Mechanism of Pressing Member)

In the case of an image heating device structured so that its pressing member 40 is stationary and also, so that as a sheet P of recording medium is conveyed through the image heating device, the sheet P slides on the stationary pressing member 40, the problems to be concerned with are: the efficiency with which a sheet P of recording medium is conveyed through the image heating device; contamination of a sheet P of recording medium by the adhesion of toner particles and the like contaminants to the pressing member 40; and durability of the pressing member 40. Thus, what is required to prevent these problems from occurring is to keep the upstream and downstream portions of the pressing member 40 relative to the fixation nip (Nt) in terms of the recording medium conveyance direction, intact in terms of the contaminant (toner particles, paper dusts, etc.) releasing properties.

One of the factors involved in the recording medium conveyance is the friction between a sheet P of recording medium and the pressing member 40. Thus, from the standpoint of the surface energy of the pressing member 40, PEEK (polyether ether ketone), various fluorinated resins, mixtures of fluorinated resins, are excellent materials for the pressing member 40. Also from the standpoint of preventing the pressing member 40 from being contaminated by the adherent substances such as toner and the like, PEEK, various fluorinated resins, and mixtures of the fluorinated resins are excellent. However, a large number of sheets P of recording medium (paper) which contains abrasive substances such as calcium carbonate particles are conveyed through the fixing device throughout the service life of the fixing device. Therefore, a pressing member formed of a resinous substance is likely to be shaved away by a sheet P of recording medium, in the fixation nip Nt, raising a concern regarding durability.

In the case of the stationary pressing member 40 in this embodiment, its substrate 41 is formed of a hard substance such as a metallic substance, whereas its parting layer 42 is formed of PEEK, or one of various fluorinated resins, or one of the mixtures of the various fluorinated resin, on one of the surfaces (43) of the substrate 41, after the surface (43) is roughened. Therefore, the surface of the substrate 41, with which a sheet P of recording medium comes into contact, is excellent not only in terms of slipperiness, but also, in terms of contaminant releasing properties.

The fixation nip Nt is high in internal pressure. Therefore, the frictional wear of the pressing member 40, which significantly affects the durability of the pressing member, is a serious concern. In the case of the stationary pressing member 40 in this embodiment, however, the presence of the tips of the numerous peaks of roughened surface of the substrate 41 at the interface between the pressing member 40 and fixation roller 30 can prevent the parting layer 42 from being frictionally worn down beyond the tips of the numerous peaks of the roughened surface 43 of the substrate 41. That is, the portions of the parting layer 42, which are in the valleys (recessed portions) of the roughened surface 43 of the substrate 41, remain unworn, being therefore capable of continuing to minimize the friction between the pressing member 40 and a sheet P of recording medium, and also, to remain virtually intact in terms of the contaminant releasing properties. That is, the problem that the portion of the parting layer 42, which corresponds in position to the fixation nip Nt, is completely worn is prevented by the tips of the numerous peaks of the roughed surface 43 of the substrate 41. Therefore, the stationary pressing member 40 in this embodiment is significantly more durable than any of conventional stationary pressing member for a fixing device.

To elaborate, in a case where the parting layer 42 is formed on a plane substrate (41), the portion of the parting layer 42, which corresponds in position to the fixation nip Nt, is easily shaved away, causing thereby the fixing device 7 to fail to properly convey a sheet P of recording medium. In this embodiment, however, the surface of the substrate 41, on which the parting layer 42 is to be formed, is roughened before the parting layer 42 is formed thereon. Therefore, as the parting layer 42 is worn to the tips of the numerous peaks of the roughened surface 43 of the substrate 41 in the fixation nip Nt, the parting layer 42 is prevented by the tips of the numerous peaks from being further worn. In other words, once the parting layer 42 is worn to where the tips of the numerous peaks of the roughened surface 43 are present, the parting layer 42 and substrate 41 (tips of peaks) continue to coexist in the fixation nip Nt. Therefore, the fixing device remains virtually intact in terms of the recording medium conveyance performance.

Figure 4:
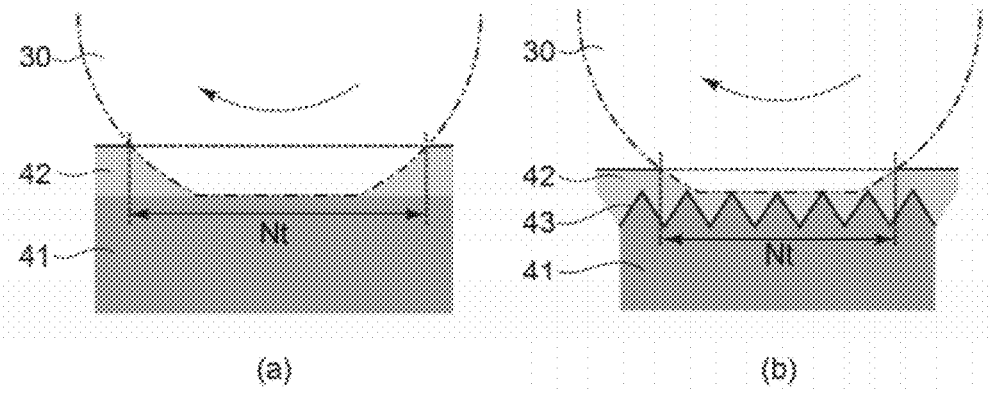
FIG. 4 is related to the function of the roughened surface of the substrate of the fixation pad in the first embodiment, FIG. 7(*a*) being a schematic sectional view of the comparative fixation pad, the substrate of which was not roughened across its surface, on which its parting layer was formed, and the FIG. 7(*b*) being a schematic sectional view of the fixation pad in the first embodiment, which was roughened across its surface, on which its parting layer was formed.

FIG. 4(*a*) shows one of the examples of a comparative pressing member (40), in which the surface of the substrate, on which the parting layer is, flat and smooth. It shows the state of the parting layer 42, in which the pressing member 40 is after the portion of the parting layer 42, which corresponds in position to the fixation nip Nt, was completely shaved away. FIG. 4(*b*) shows the pressing member 40 in this embodiment, the pressing of member 40 of which is rough across its surface which is in contact with the parting layer 42. It shows the state in which the portion of the parting member 42, which corresponds in position to the fixation nip Nt, is after this portion was shaved enough by the fixation roller 30 and sheets P of recording medium for the tips of the numerous peaks of the roughened surface of the substrate 41 to be exposed. Incidentally, in order to make it easier to explain the difference between the pressing member 40 in this embodiment and the comparative pressing member, the two drawings were drawn so that the peaks (protrusions) and valleys (recess) of the substrate 41 appear larger than their actual sizes, and also, so that the parting layer 42 appears thicker than its actual thicknesses. Various contaminations of a sheet P of recording medium by the fixing device, which are attributable to the toner adhesion to the fixation pad, occur on both the upstream and downstream sides of the fixation nip Nt, in particular, on the downstream side of the fixation nip Nt. Referring to FIG. 4(*a*), in a case of the example of a comparative image heating apparatus, as the shaving of the parting layer 42 continues, the fixation roller 30 eventually comes into contact with the flat and smooth surface of the pressing member 40. In comparison, referring to FIG. 4(*b*), in the case of the fixing device in this embodiment, even after the parting layer 42 is shaved, a certain amount of the material of the parting layer 42 remains in each of the numerous recesses of the roughened surface 43 of the substrate 41, and further, the portions of the parting layer 42, which are outside the fixation nip Nt, remains virtually in the their initial state. Therefore, the pressing member 40 in this embodiment can remain virtually free of contaminants throughout its service life. In other words, it can make it possible to provide an image heating apparatus which is stable in recording medium conveyance performance, durable, and unlikely to be soiled by toner and/or the like contaminants.

(Comparison Tests)

The fixing device 7 in this embodiment was evaluated in terms of durability with the use of the printer 1, the image heating device (fixing device) of which is the fixing device 7 in this embodiment. More specifically, a substantial number of prints were made using the printer 1 and sheets P of recording medium, and it was checked whether or not the printer 1 (fixing device 7) reduced in recording medium conveyance performance, whether or not the pressure applying member 40 (parting layer 42) was frictionally shaved, and whether or not the contaminants (toner) adhered to the sheets P of recording medium. The image forming apparatus (printer) used for the tests was a laser beam printer, which was 116 mm/sec in process speed, and outputted 19 prints per minute. First, referring to FIGS. 1-3, the basic structure of the fixing apparatus 7 in this embodiment is described.

The heater 21 was a ceramic heater. It was made up of a ceramic substrate 21*a*, a heat generating resistor layer 21*b*, and a protective layer 21*c*. The substrate 21*a* was 1.0 mm in thickness. The heat generating resistor layer 21*b* was formed on the substrate 21*a* by coating one of the primary surfaces of the substrate 21*a* with paste of heat generating resistor made up of silver and palladium. It was 10 μm in thickness. The ceramic heater 21 was held by the holder 23 formed of a mixture of adiabatic liquid polymer and hollow resin particles. The protective layer 21*c* was formed of electrically nonconductive glass, in a manner of covering not only the heat generating resistor layer 21*b*, but also, the entirety of the surface of the substrate 21*a*, on which the heat generating resistor layer 21*b* was present. The thickness of the glass layer is 30 μm. Further, there is a thermistor, as a temperature detecting means, for controlling the ceramic heater 21 in temperature. The thermistor is on the opposite surface of the substrate 21*a* from the protective layer 21*c*, and is in contact with the ceramic heater 21. The heater 21 is controlled in temperature in response to its temperature detected by the temperature detecting means (thermistor) so that its temperature remains at roughly 210° C.

The fixation roller 30 comprises: a metallic core 31, an adiabatic elastic layer 32, a thermally conductive layer 33, and a parting layer 34. The metallic core 31 is 6 mm in external diameter, and is made of SUM. The diabatic elastic layer 32 is formed of silicone rubber, and is 30 mm in thickness. It covers virtually the entirety of the peripheral surface of the metallic core 31. The thermally conductive layer 33 is formed of solid silicone rubber, and is 100 μm in thickness. It covers the entirety of the outward surface of the diabatic elastic layer 32. The parting layer 34 is formed of a mixture of fluorinated resin and filler, and is 20 μm in thickness. It covers the entirety of the outward surface of the thermal conductive layer 33. That is, the fixation roller 30 is made up of the metallic core 31, and three functional layers coated in layers on the peripheral surface of the metallic core 31.

The material for the substrate 41 of the pressing member 40 is zinc-plated steel plate, which is 0.8 mm in thickness. The surface layer, that is, zinc layer, of the zinc-plate steel plate was thermally removed. Then, the exposed steel surface was blasted to roughen the surface to obtain the pressing member 41, one of the surfaces (43) of which is rough. After the blasting, the roughness of the blasted surface of the steel plate was 2 μm in Ra, and 10 μm in Rz.

Ra stands for "Value of Arithmetic Means Deviation of the Profile". which is value (in μm) obtained by folding in half the graph, which shows the roughness curve, at the centerline of the curved line, and then, dividing the size of the area surrounded by the curved line, centerline, and horizontal axis of the graph, with the length L of the corresponding portion of the horizontal axis. Rz stands for "Value of Ten-Point Height of Irregularities", which is obtained by the following method: An average height of the peaks of the roughened surface is obtained from the roughness curve, and the sum of the absolute value of average height of the highest peak to the fifth highest peak measured from the average height of the peaks, and the absolute value of the average depth of the deepest valley to the fifth deepest valley measured from the average height of the peaks (average depth of valleys) used as "Value (in micrometer) of Ten-Point Height of Irregularities".

In this embodiment, the parting layer 42 was formed by coating the roughened surface 43 of the substrate 41 with a mixture of PEEK, PFA, and electrically conductive substance to a thickness D of 20 μm (D=20) relative to the peaks of the roughened surface 43, and sintering the combination. In this embodiment, roughening one of the surfaces of the substrate 41 was done by shot-blasting. However, the roughening method does not need to be limited to shot-blasting.

With the fixing device 7 structured as described above, the heating nip Nh, which is 3 mm in width, is formed between the heater 21 and fixation roller 30 by the application of 49 N (5 kg) of pressure. Further, the fixation nip Nt, which is 3 mm in width, is formed between the pressing member 40 and fixation roller 30 by the application of 49 N (5 kg) of pressure. As for the positioning of the heater 21 and pressing member 40, the former is positioned on the opposite side of the fixation roller 30 from the latter, with reference to the axial line of the fixation roller 30.

FIG. 5(*a*) is a sectional view of the pressing member 40 in this embodiment, and shows the general structure of the pressing member 40. FIGS. 5(*b*)-5(*c*) are sectional views of the comparative pressing members, and show their general structure, respectively. First, referring to FIG. 5(*a*), which shows the pressing member 40 in this embodiment, the thickness D of the parting layer 42 of which was measured from the peaks of the roughed surface of the substrate 41, was 20 μm. FIG. 5(*b*) is a sectional view of the first comparative pressing member (40), which was made up of a substrate (41) formed of zinc-plated steel plate, and a piece of 100 μm thick PTFE plate (thick plate) bonded to the substrate (41). FIG. 5(*c*) is a sectional view of the second comparative pressing member (41), which was made up of a substrate (41) formed of zinc-plate steel plate, and a fluorinate resin layer formed on the substrate (41) by coating a mixture of PFA, PTFE, and bonding agent, directly on the substrate (41). FIG. 5(*d*) is a sectional view of the third comparative pressing member (40), which was made up of a substrate (41) formed of zinc-plated steel plate, and a DLC (Diamond-like Carbon) layer coated on the substrate (41).

Figure 6:
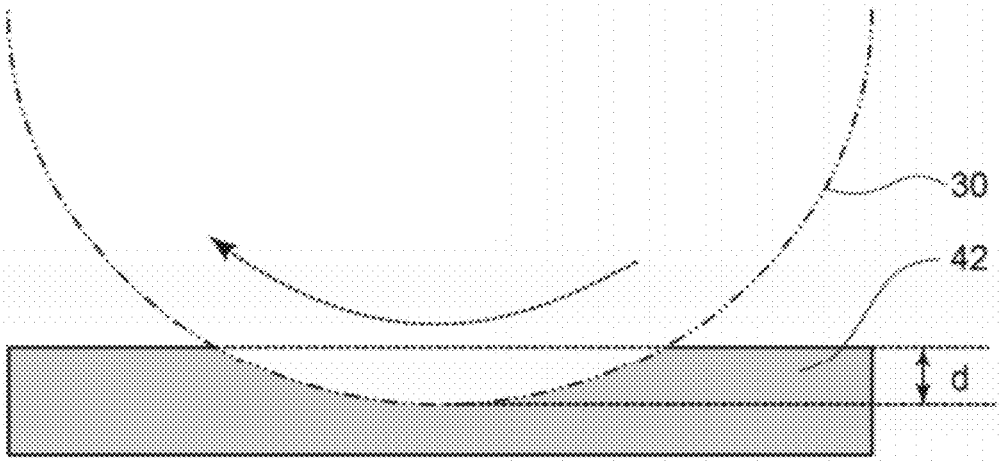
FIG. 6 is a schematic drawing for describing the amount d of the frictional wear of the parting layer of a fixation pad.

The fixing device 7 in this embodiment was compared in terms of function and durability, with the first, second, and third comparative fixing device (7), using the printers 1 equipped with the fixing device 7 in this embodiment, and the comparative fixing devices (7), one for one. The four fixing devices are the same in structure except for their pressing members. In the tests, an image made up of multiple horizontal lines was continuously printed on no less than 30,000 letter size sheets of ordinary paper (75 g in basis weight), while checking whether or not each sheet P of recording medium was properly conveyed, measuring the amount by which the parting layer 42 of the pressing member 40 had been frictionally worn, as shown in FIG. 6, and also, examining whether or not the leading edge portion of the backside of the sheet P, in terms of the recording medium conveyance direction, was soiled by the toner which had transferred onto the pressing member 40, at when the pressing member 40 was brand-new, and after the 1,000th, 5,000th, 10,000th, and 30,000th sheets P was conveyed.

The results of the tests are given in Table 1, which shows the results of the evaluation of the aforementioned four fixing devices (pressing members) in terms of the recording medium conveyance. In Table 1, "G" indicates that there was no recording medium conveyance problems, including slipping, paper jam attributable to the straying of the sheet P, and "NG" stands for a sheet conveyance error.

TABLE 1

| Test Results | No. of processed sheets | | | |
|---|---|---|---|---|
| | 1000 | 5000 | 10000 | 30000 |
| Embodiment 1 | G | G | G | G |
| Comp. Ex. 1 | G | G | NG | — |
| Comp. Ex. 2 | G | NG | — | — |
| Comp. Ex. 3 | G | NG | — | — |

It is evident from the test results given in Table 1 that the fixing device (pressing member) in this embodiment is significantly better than the comparative fixing devices (pressing members), in terms of the reliability with which a substantial number of sheets P of recording medium can be continuously conveyed through a fixing device, and also, durability. That is, the fixing device in this embodiment satisfactorily conveyed even the 30,000th sheet P of recording medium, whereas the comparative fixing devices failed to properly convey a sheet P of recording medium in early stages of the tests. That is, in the case of the first comparative fixing device, it began to fail after the 5,000th sheet P of recording medium; the paper jam attributable to the problem that a sheet P of recording medium curls and strays from the recording medium path began to frequently occur. Further, as the substrate was exposed, the "slipping" began to occur; in the case of the second comparative fixing device, after the conveyance of roughly the 1,500th sheet P of recording medium, the portion of the parting layer 42, which corresponds in position to the fixation nip Nt, was peeled away, exposing thereby the substrate 41, which in turn caused the "slipping". In the case of the third comparative fixing device, the recording medium conveyance error, which seems to be attributable to the contaminant adhesion (which will be described later) to the pressing member 40, began to occur after the conveyance of roughly the 2,000th sheet P of recording medium.

Referring to FIG. 6, the amount d of frictional wear of the parting layer 42 of the pressing member 40 is indicated by the depth of the recess created in the portion of the parting layer 42, which corresponds in position to the fixation roller 30. The results of the evaluation are given in Table 2.

TABLE 2

| Results of Evaluation | No. of processed sheets | | | |
|---|---|---|---|---|
| | 1000 | 5000 | 10000 | 30000 |
| Embodiment 1 | 18 μm | 20 μm | 21 μm | 22 μm |
| Comp. Ex. 1 | 21 μm | 96 μm | 101 μm | — |
| Comp. Ex. 2 | 18 μm | 21 μm | — | — |
| Comp. Ex. 3 | 0 μm | 0 μm | — | — |

It is evident from the results of the evaluation given in Table 2 that the fixing device (pressing member) in this embodiment is significantly better in durability than the comparative fixing devices. That is, in the early stage of the usage, the parting layer (surface layer) of the pressing member 40 in this embodiment was also frictionally worn like the first and second comparative pressing members. However, in the case of the pressing member 40 in this embodiment, as the peaks of the roughened surface 43 of the substrate 41 became exposed from the parting layer 42, the parting layer 42 was prevented from being frictionally worn further.

It is also evident from Table 2 that since the parting layer 42 of the first comparative pressing member was formed of thick plain PTFE, it continued to be frictionally worn as the print count increased. As is evident from the test results in Table 2 along with Table 1, the thicker the parting layer 42, the deeper the recess created by the frictional wear of the parting layer 42 in the portion of the parting layer 42, which corresponds in position to the nip Nt, because the parting layer 42 continues to be frictional worn. That is, it was greater in the amount of the change which occurs to the shape of the fixing nip Nt, which in turn caused such a problem as curling of a sheet P of recording medium, and the resultant paper jams. In the case of the second comparative fixing device (pressing member), as roughly the 1,500th sheet P of recording medium was conveyed, the coated parting layer, which is the surface layer of the pressing member 40, disappeared from the portion of the pressing member 40, which corresponds in position to the fixation nip Nt, due to its frictional wear. Consequently, the "slipping" made it impossible for a sheet P of recording medium to be properly conveyed, and therefore, the test was ended. In the case of the third comparative fixing device (pressing member), no frictional wear occurred to the pressing member 40, because the DLC is very hard. However, the fixing device began to fail to properly convey a sheet P of recording medium after roughly the 2,000th sheet P of recording medium was conveyed, as described above.

From the standpoint of parting properties and frictional resistance, DLC is inferior to PEEK and fluorinated resins. Thus, as the print count increased, the third comparative pressing member became significantly greater in the amount of the contaminants having adhered thereto, and therefore, significantly greater in frictional resistance, which in turn reduced the efficiency with which a sheet P of recording medium can be conveyed by the fixation roller 30. This seems to be why the third comparative fixing device (pressing member) was drastically different from the others in recording medium conveyance performance.

Regarding the detection of the contaminant adhesion to the leading edge portion of the backside of a sheet P of recording medium in terms of the recording medium conveyance direction, the presence or absence of the contaminants was examined with naked eyes. The results of the tests are given in Table 3, in which "G" indicates that no contaminant adhesion was visible; "F" indicates that contaminant adhesion was subtle enough to be undetectable unless it is intensively sought; and "NG" indicates that the contaminant adhesion was clearly visible.

TABLE 3

| Test Results | No. of processed sheets | | | |
|---|---|---|---|---|
| | 1000 | 5000 | 10000 | 30000 |
| Embodiment 1 | G | G | G | G |
| Comp. Ex. 1 | G | G | G | — |
| Comp. Ex. 2 | G | G | — | — |
| Comp. Ex. 3 | F | NG | — | — |

It is evident from the test results given in Table 3 that the pressing member in this embodiment is significantly more resistant to the contaminant adhesion than the comparative pressing members. That is, in the case of the pressing member in this embodiment, no contaminant adhesion was detectable on the leading edge portion of the backside of even the 3,000th sheet P of recording medium. Further, no contaminant adhesion was visible neither on the upstream nor downstream portion of the surface layer of the parting layer 42 of the pressing member, relative to the fixation nip Nt. The first and second comparative pressing members were problematic in that they began to be erratic in terms of recording medium conveyance. However, they were not problematic in terms of the contamination of the leading edge portion of the backside of a sheet P of recording medium. In the case of the third comparative pressing member, the presence of slight contamination was confirmed on roughly the 1,000th sheet P of recording medium. Further, the examination of the surface of the parting layer of the pressing member revealed that the toner had adhered to the downstream portion of the surface of the parting layer of the pressing member, relative to the fixation nip Nt, which seems to be the reason why the third comparative pressing member was insufficient in parting properties.

From the test results given above, it was possible to confirm the following: In the case of each pressing member which was not roughened across its surface on which the parting layer 42 was formed, as the fixing device increased in the cumulative length of its operation, its parting layer 42 continued to be frictionally worn, and eventually, there was no parting layer left on the portion of the substrate 41, which corresponds in position to the fixation nip Nt. The substrate 41 is relatively large in frictional resistance. Therefore, if an image forming operation is continued after the substrate 41 is exposed, the fixing device 7 fails to properly convey a sheet P of recording medium. In comparison, in the case of a pressing member such as the one in this embodiment, the substrate 41 of which was roughened across its surface, on which its parting layer 42 was to be formed, before the parting layer 42 was formed, as soon as the peaks of the roughened surface of the substrate 41 are exposed, the shaving of the parting layer 42 drastically slows down. When the shaving of the parting layer 42 drastically slows downs, the material for the substrate 41 and the material for the parting layer 42 are coexistent across the portion of the surface of the pressing member, which is in the fixation nip Nt and faces the fixation roller 30. Therefore, the shaving of the material of the parting layer 42 is impeded by the material of the substrate 41, enabling thereby the remaining parting layer 42 to keep the pressing member 40 low in frictional resistance, and excellent in parting properties. Further, as the parting layer 42 is prevented from being further shaved away, the nip Nt is prevented from being further deformed. Therefore, it is ensured that the fixing device 7 can continue to properly convey a sheet P of recording medium.

As described-above, in the case of the fixing device 7 in this embodiment, before the parting layer 42 of its pressing member 40 is formed on the substrate 41 of the pressing member 40, the surface of the substrate 41, on which the parting layer 42 of the pressing member 40 is to be formed, is roughened. Therefore, the pressing member 40 of the fixing device 7 remains low in the coefficient of friction throughout its service life, being therefore capable of ensuring that the fixing device 7 continues to properly convey a sheet P of recording medium, and also, preventing the soiling of a sheet P of recording medium, which is attributable to the adhesion of contaminants such as toner particles to the pressing member 40.

(Heating Means Structure Different from One in First Embodiment)

In the case of the fixing device 7 in this embodiment, the image heating means is a combination of the fixation roller 30, and the heater 21 positioned to remain in contact with the peripheral surface of the fixation roller 30 as the fixation roller 30 is rotated. However, the heating means does not need to be limited to the one in this embodiment.

For example, the heating means may be: a combination of a heater (21), a fixation roller (30), and a flexible fixation film circularly movable between the heater 21 and fixation roller 30 (so-called film-based heating method); a combination of a hollow cylinder and a halogen heater or the like positioned in the hollow of the cylinder (so-called heat roller type). Further, the peripheral surface of the fixation roller 30 may be externally and indirectly heated by the radiant heat from a halogen heater (so-called IH heating method).

(Fixing Means Structure Other than One in First Embodiment)

The rotational fixing member of the fixing device 7 in this embodiment was the fixation roller 30 which is externally heated. The choice of the rotational fixing member for the fixing device 7 does not need to be limited to the fixation roller 30 in this embodiment. All that is required of the rotational fixing member is that the rotational fixing member form a fixation nip Nt between itself and the pressing member 40 to thermally fix the toner image T on a sheet P of recording medium. For example, a so-called heat roller, that is, a combination of a hollow metallic roller, and a heating means such as a halogen heater placed in the hollow of the metallic roller, may be employed as the rotational fixing member.

(Roughness of Roughened Surface 43 of Substrate 41)

In the case of the pressing member 40 in this embodiment, the roughness of the roughened surface 43 of the substrate 41 was 2 μm in Ra, and 10 μm in Rz. However, this embodiment is not intended to limit the present invention in the level to which the surface (43) of the substrate 41 is to be roughened. If the roughness of the roughened surface 43 of the substrate 41 is less than a certain value, the adhesion between the substrate 41 and parting layer 42 is insufficient, which sometimes causes the portion of the parting layer 42, which corresponds in position to the nip Nt, to separate from the substrate 41, leaving thereby the roughened surface 43 of the substrate 41 exposed. On the other hand, if the roughness of the roughened surface 43 of the substrate 41 is more than a certain value, the roughened surface 43 of the substrate 41 is sometimes unevenly exposed (peaks are haphazardly exposed), affecting thereby the manner in which the fixing device 7 conveys a sheet P of recording medium.

Six types of pressing members 40, which were different in the roughness of the roughened surface 43, were made by changing a blasting means in the size of the blasting particles and the blasting pressure, and were compared in durability with the use of tests in which a substantial number of sheets P of recording medium were continuously conveyed through fixing devices equipped with the pressing members 40. They were the same except for the roughness of the roughened surface 43, and the thickness of the parting layer 42 (parting layers were formed by coating roughened surface 43 with material for parting layer to actually measured thickness of roughly 20 μm relative to peaks). The roughness values of the first-sixth types were: 0.5 μm in Ra and 1.5 μm in Rz; 1.0 μm in Ra and 3.0 μm in Rz; 2.0 μm in Ra and 10.0 μm in Rz; 8.0 μm in Ra and 42.0 μm in Rz; 15.0 μm in Ra and 58.0 μm in Rz; and 20.0 μm in Ra and 79.0 μm in Rz, respectively. These samples were evaluated in recording medium conveyance performance, using the same tests as those used to evaluate the pressing member 40 in the first preferred embodiment of the present invention. The results of the evaluation in recording medium conveyance performance are given in Table 4. Table 5 is the summary of the effects of the roughness of the roughened surface of the substrate 41 of the pressing member 40, and the nonuniformity in the height of the peaks of the roughened surface of the substrate 41 of the pressing member 40, upon the recording medium conveyance performance of a fixing device.

The values which indicate the degree of nonuniformity in the height of the peaks of the roughened surface 43 in Table 5 were obtained using the following method: The profile (roughness) of the roughened surface 43 of each pressing member were measured across a length of 10 mm, and 5 point-average roughness was calculated. Then, the difference between the largest and smallest values was used as the indexes for the degree of nonuniformity in the height of the peaks of the roughened surface 43.

TABLE 4

Test Results

| | No. of processed sheets | | | |
|---|---|---|---|---|
| | 1000 | 5000 | 10000 | 30000 |
| Type 1 | G | NG | — | — |
| Type 2 | G | G | G | G |
| Type 3 | G | G | G | G |
| Type 4 | G | G | G | G |
| Type 5 | G | G | G | G |
| Type 6 | G | G | NG | NG |

TABLE 5

Influence of Roughness Profile to Feeding Property

| | Ra | Rz | Unevenness | Feeding |
|---|---|---|---|---|
| Type 1 | 0.5 μm | 1.5 μm | 0.1 μm | NG |
| Type 2 | 1 μm | 3 μm | 0.2 μm | G |
| Type 3 | 2 μm | 10 μm | 0.9 μm | G |
| Type 4 | 8 μm | 42 μm | 5 μm | G |
| Type 5 | 15 μm | 58 μm | 17 μm | G |
| Type 6 | 20 μm | 79 μm | 31 μm | NG |

The results of the evaluation of the type 1 was attributable to the fact that the portion of the parting layer 42, which corresponds in position to the nip Nt, was peeled away. It seems to be reasonable to think that because the roughened surface 43 was rather small in roughness value, the adhesion between the roughened surface 43 and parting layer 42 was insufficient in strength. It seems that in the case of the type 6, as the parting layer 42 was shaved away (frictionally worn), the peaks of the roughened surface 43 were haphazardly exposed in terms of the lengthwise direction of the nip Nt, which in turn caused the improper conveyance of a sheet P of recording medium. Referring to Table 6, the rougher the roughened surface 43 of the substrate 41, the more nonuniform in height the peaks of the roughened surface 43. Therefore, as the parting layer 42 is shaved away, the peaks are randomly exposed. As a result, the pressing member 40 (roughened surface 43) becomes nonuniform, in terms of its lengthwise direction, in the amount of frictional resistance between itself and a sheet P of recording medium, and further, the leading edge of the sheet P of recording medium is likely to be hung up by some of the randomly exposed peaks of the roughened surface 43 of the substrate 40. In other words, the rougher the roughened surface 43 of the pressing member 40, the higher the probability with which a sheet P of recording medium will be hung up in the nip Nt. This seems to be why the rougher the roughened surface 43 of a pressing member 40, the lower the pressing member 40 in the recording medium conveyance performance.

Therefore, the roughness of the roughened surface 43 of the substrate 41 of the pressing member 40, in terms of Ra and Rz, is desired to satisfy the following inequalities:

$$1\ \mu m \leq Ra \leq 15\ \mu m, \text{ and}$$

$$3\ \mu m \leq Rz \leq 60\ \mu m.$$

Incidentally, regarding the method for manufacturing the pressing member 40 in this embodiment, in order to minimize the pressing member 40 in the nonuniformity in height among the peaks of the roughened surface 43, the roughened surface 43 may be polished, although this adds to the number of manufacturing steps. In a case where this method is used to manufacture the pressing member 40 in this embodiment, there is no limit to the roughness of the roughened surface 43. Even in the case where the polishing step is added, however, the above described roughness indexes Ra and Rz are desired to satisfy the following inequalities: 1 μm≤Ra, and 3 μm≤Rz, and the extent of nonuniformity among the peaks is desired to be no more than roughly 20 μm, which is evident from the test results given in Table 5.

As will be evident from the detailed description of the first preferred embodiment of the present invention, according to the present invention, when manufacturing a pressing member for a fixing device, the surface of the pressing member, on which its parting layer is to be formed, is roughened before the parting layer in formed. Therefore, the pressing member in accordance with the present invention is significantly smaller in the amount by which its parting layer is frictionally worn (shaved), and also, the frequency with which the parting layer is likely to be peeled away than any conventional pressing member. Therefore, the present invention can provide an image heating device which is significantly longer in service life, better in recording medium conveyance performance and parting properties than any conventional image heating device.

<<Embodiment 2>>

Figure 7:
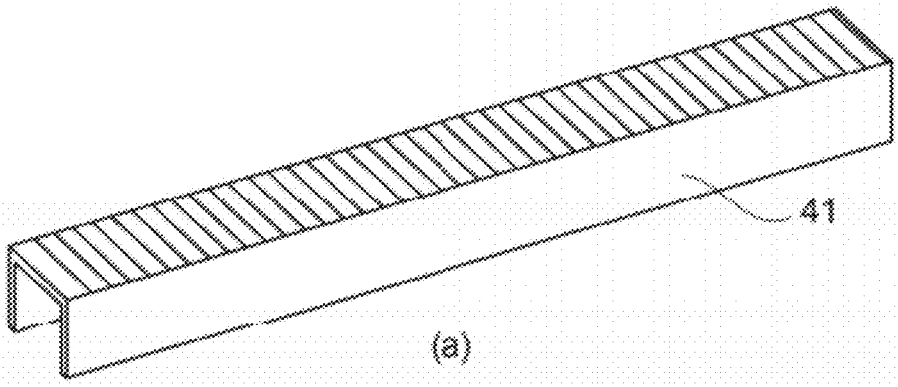
FIG. 7 is related to the fixation pad in the second preferred embodiment of the present invention, FIGS. 7(*a*) and 7(*b*) being an external perspective view of the substrate of the fixation pad, and a schematic sectional view of the fixation pad, at a vertical plane perpendicular to the lengthwise direction of the fixation pad.
Figure 7:
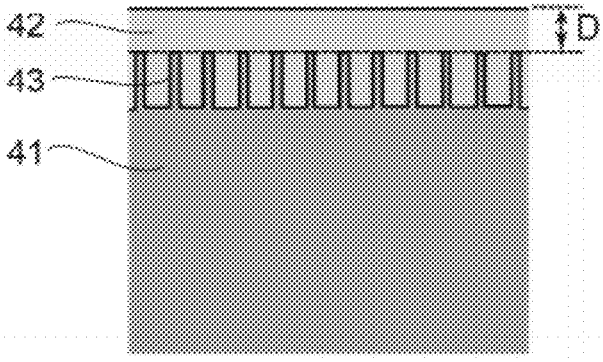

FIG. 7 is a schematic drawing for showing the structure of the pressing member 40 in the second preferred embodiment of the present invention. FIG. 7(*a*) is a schematic external perspective view of the substrate 41 of the pressing member 40, and shows the state of the substrate 41 after the roughening of the surface (43) of the substrate 41, on which the parting layer 42 is to be formed. FIG. 7(*b*) is a schematic sectional view of the pressing member 40, at a plane parallel to the lengthwise direction of the pressing member 40, after the formation of the parting layer 42, and shows the structure of the pressing member 40. Referring to FIG. 7(*a*), also in this embodiment, the pressing member 40 is made up of a substrate 41 and a parting layer 42. Like the pressing member 40 in the first embodiment, the parting layer 42 is formed on the roughened surface 43 of the substrate 41, and is thick enough to immerse the peaks of the roughened surface 43 in itself.

In the first embodiment, the surface 43 of the substrate 41, across which the parting layer 42 was to be formed, was roughened by blasting. However, it is rather difficult to deeply roughen the surface 43 by blasting, without increasing the surface 43 in the nonuniformity. Further, it is also rather difficult to roughen the surface 43 by blasting so that the resultant peaks are relatively uniformly in height.

In this embodiment, therefore, the surface 43 of the substrate 41 was roughened with the use of a belt grinder. More specifically, the surface 43 was given numerous parallel slits, which were controlled in depth. Therefore, the roughened surface 43 of the substrate 41 in this embodiment was greater in roughness, and the peaks of the roughened surface 43 were less nonuniform in height than those in the first embodiment.

The pressing member 40 in this embodiment is also made up of the substrate 41 and parting layer 42. The substrate 41 is formed of 0.8 mm thick zinc-plated steel plate. One surface 43 of the substrate 41 was roughened. More specifically, first, the zinc plate, or the surface layer, was removed from one of the two primary surfaces, and then, numerous slits which were parallel to the widthwise direction of the substrate 41 were formed across the entirety of the surface of the substrate 41, which was free of the zinc-plate, with the used of a belt grinder. After the processing of the surface 43, the roughness of the surface 43 was 8 μm in Ra, and 42 μm in Rz. Then, the mixture of PEEK and PFA, that is, the material for the parting layer 43, was coated on the roughened surface 43 of the substrate 41 to a thickness of 20 μm relative to the median height of the peaks of the roughened surface 43, and then, the coated layer was sintered. In this embodiment, a belt-grinder was used to provide one of the primary surfaces of the substrate 41 with numerous slits which are parallel to the widthwise direction of the substrate 41. However, this embodiment is not intended to limit the present invention in the method for providing the substrate 41 with the slits.

Also in the case of the pressing member 40 in this embodiment, as the fixing device 7 increased in the cumulative length of usage, the nip portion of the parting layer 42 was frictionally worn. However, the worn portion of the parting layer 42 was uniform in thickness in terms of the widthwise direction of the substrate 41, and the surface of the worn portion was virtually flat. Further, in terms of the lengthwise direction of the pressing member 40, the bodies of the material of the substrate 41 and the bodies of the material of the parting layer 42 are alternately exposed across the surface of the worn portion of the parting layer 42, as shown in FIG. 7(*b*). Therefore, as a sheet P of recording medium was conveyed to the nip Nt, it came into contact with numerous parallel linear peaks, which were uniform in height. In comparison, in the case of the pressing member 40 in the first embodiment, which was processed by blasting, as the nip portion of the parting layer 42 was frictionally worn, the pointy peaks of the roughened surface 43 were haphazardly exposed. Therefore, as a sheet P of recording medium was conveyed to the nip Nt, the contact between the leading edge of the sheet P and the parting layer 42 of the pressing member 40 was not uniform across the leading edge.

The pressing member 40 in this embodiment was subjected to the same tests as those used to test the pressing members 40 in the first embodiment, and type 1-6 comparative pressing members 40, in order to evaluate the pressing member 40 in this embodiment in recording medium conveyance performance, amount d of frictional wear, and contaminant resistance. The evaluation results are given in Table 6.

TABLE 6

| | Test Results | | | |
|---|---|---|---|---|
| | No. of processed sheets | | | |
| | 1000 | 5000 | 10000 | 30000 |
| Feeding | G | G | G | G |
| Wear d | 18 μm | 20 μm | 21 μm | 22 μm |
| Contamination | G | G | G | G |

In this embodiment, the surface (43) of the substrate 41 of the pressing member 40, on which the parting layer 42 was to be formed, was given numerous slits by a belt grinder to make the surface (43) rough in texture. Thus, after the nip portion of the parting layer 42 was frictionally worn, the resultant surface of this portion of the parting layer 42 was a patch work of alternately and uniformly positioned bodies of the material of the parting layer 42 and the bodies of the material of the substrate 41, in terms of the lengthwise direction of the pressing member 40. It is evident from Table 6 that the pressing member 40 in this embodiment was satisfactory in terms of recording medium conveyance performance, wear resistance, and contaminant resistance throughout the durability tests in which a substantial number of sheet P of ordinary paper were continuously conveyed through the fixing device.

Further, the height of each peak of the roughed surface 43 of the substrate 41 of the pressing member 40 in this embodiment is the same as the average height of the peaks of roughened surface 43 of the substrate 41 of the pressing member 40 in the first embodiment. As long as the height of each peak is within the aforementioned range, the pressing member 40 in this embodiment is effective regardless of the roughening method, and the shape in which the peaks are formed.

Further, in this embodiment, as the nip portion of the parting layer 42 of the pressing member 40 is frictionally worn, the resultant surface of this portion of the parting layer 42 emerges as a patch work of alternately and uniformly positioned bodies of material of the parting layer 42 and the bodies of material of the substrate 41. Thus, if the ratio of the material of the substrate 41 relative to the surface of the worn portion of the parting layer 42 becomes dominant, the pressing member 40 drastically increases in the amount of the friction between itself and a sheet P of recording medium, which may have an adverse effects on the fixing device 7 in terms of recording medium conveyance performance. Thus, the pressing member 40 in this embodiment was subjected to the tests in which the change in the ratio in size between the surface of the parting layer 42 and the sum of the exposed top surfaces of the peaks of the substrate 41 has on the fixing device in terms of recording medium conveyance performance was examined.

For the sake of simplification, the ratio at which the roughened surface 43 of the substrate 41 was occupied by the material of the parting layer 42 was approximated with the ratio of the sum of the recess areas relative to the roughened surface 43 of the substrate 41. Numerous linear peaks which were 70 μm in width and 50 μm, were formed on one of the primary surfaces of the substrate 41, by electrical discharge, in such a manner that as the parting layer 42 would be frictionally worn enough to barely expose the peaks, the ratio of the parting layer material would become 80%, 60%, 40% and 20%, as shown in Table 7. Then, the parting layer 42 was formed by coating, on the roughened surface 43 of the substrate 41. Then, the pressing member 40 was evaluated by being subjected to the aforementioned durability test, in which a large number of sheets P of recording medium were continuously conveyed through the nip Nt. The test results are given in Table 7, in which the ratio (%) of the parting layer material is the ratio with which the parting layer material occupied the surface of the nip portion of the parting layer 42 when the substrate material became exposed. It was obtained using the following equation: parting layer ratio=100×(total area of parting layer material)/(total area of parting layer material+total area of substrate material). The parting layer 42 was formed to a thickness of 20 μm from the tip of each peak of the roughened surface 43 of the substrate 41. In Table 7, "G" indicates that 30,000 sheets P of ordinary paper were conveyed through the nip Nt, with no problems, and "NG" indicates that recording medium conveyance problems such as slipping occurred while 30,000 sheets P were conveyed.

TABLE 7

| Test Results | | | | |
|---|---|---|---|---|
| Ratio | 80% | 60% | 40% | 20% |
| Feeding | G | G | G | NG |

As is evident from Table 7, the greater the ratio of the parting layer 42 in the nip Nt, the longer the length of time the pressing member 40 remains satisfactory in recording medium conveyance performance. As the ratio of the parting layer 42 falls to 20%, that is, as the ratio by which the parting layer 42 occupies the nip portion of the surface of the pressing layer 40 reduces, and therefore, the ratio by which the substrate 41 occupies the nip portion of the surface of the pressing layer 40 increases, the pressing member 40 increases in the frictional resistance between itself and a sheet P of recording medium, which affects a fixing device in recording medium conveyance performance. Thus, the ratio in area size by which the parting layer 42 occupies the nip portion of the surface of the pressing member 40 is desired to be no less than 40%.

Figure 10:
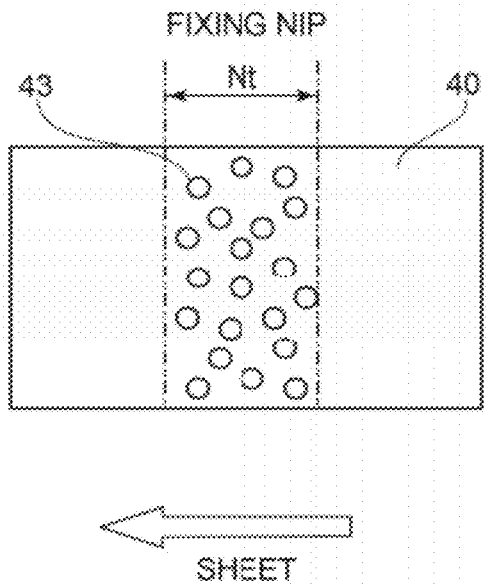
FIG. 10 is a plan view of one of the modified versions of the fixation pad in accordance with the present invention, the fixation nip portion of the substrate of which are provided with flat peaks.

Further, it was stated that in the second embodiment, the surface of the substrate 41, on which the parting layer 42 was to be formed, was roughened by providing the surface with numerous parallel slits. However, the second embodiment is not intended to limit the present invention in terms of the pattern in which the surface of the substrate 41 is to be roughened. For example, the surface of the substrate 41 may be roughened as shown in FIG. 10. That is, the surface may be roughened by marking one of the primary surface of the substrate 41 with "G" marks, and then, removing the substrate material from the unmarked areas.

<<Embodiment 3>>

Figure 9:
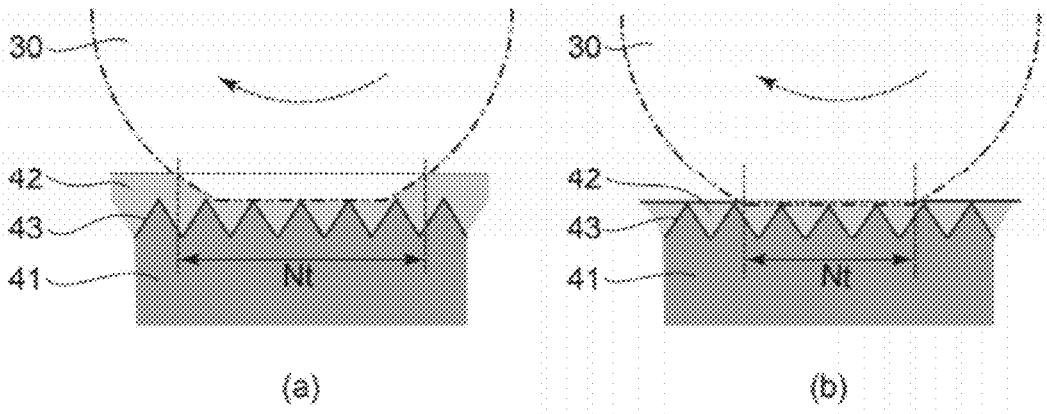
FIG. 9(*a*) is schematic sectional view of one of the comparative fixation pad after the fixation nip changed in shape because the parting layer of the pad was too thick, and FIG. 9(*b*) is a schematic sectional view of the fixation pad in the third preferred embodiment of the present invention, showing that because the parting layer of the fixation pad was virtually zero, the fixation nip did not change in shape.

In the first and second embodiments, the surface 43 of the substrate 41 of the pressing member, on which the parting layer 42 was to be formed, was roughened to prevent the problem that the nip portion of the parting layer 42 of the pressing member is quickly and completely shave away. With the roughening of the surface 43, it was possible to keep the pressing member 40 relatively low in the friction between itself and a sheet P of recording medium, significantly longer period of time than any conventional pressing member. However, if the thickness D of the parting layer 42 is as thick as shown in FIG. 9(*a*), as the cumulative number of sheets P of recording medium conveyed through the nip Nt increases, the nip Nt drastically changes in shape compared to the shape in which it is initially. This change in the shape of the nip Nt sometimes causes the problem that a sheet P of recording medium is made to curl, and/or a fixing device is jammed with the sheet P.

In this embodiment, therefore, the pressing member 40 is formed so that even when the pressing member 40 is brand-new, the peaks of the substrate 41 are exposed through the parting layer 42 as shown in FIG. 9(*b*). With this design for the pressing member 40, the shaving of the parting layer 42 is impeded from the very beginning of the usage of the pressing member 40. Thus, the changes which occur to the shape of the nip Nt as the cumulative number of sheets P of recording medium increases are relatively small. In other words, the material for the parting layer 42 is applied only to the valleys (recess) of the roughened surface 43 of the substrate 41 so that the valleys are filled with the material.

Figure 8:
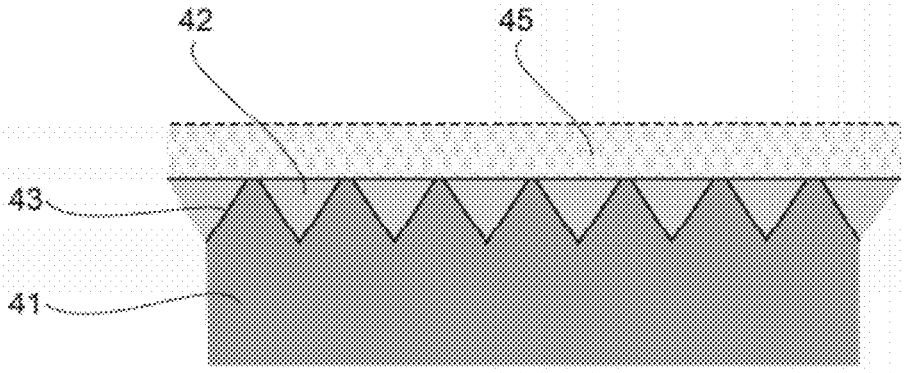
FIG. 8 is a schematic sectional view of the fixation pad in the third preferred embodiment, at a vertical plane parallel to the lengthwise direction of the fixation pad.

FIG. 8 is a schematic sectional view of the pressing member 40 in this embodiment, and shows the general structure of the member 40. The pressing member 40 in this embodiment was made up of a substrate 40 and a parting layer 42. The substrate 40 was formed of 0.8 mm thick zinc-plated steel plate. First, the zinc plate, or the surface layer, of the substrate 41 was thermally removed, and the surface 43 of the substrate 41, on which the parting layer 42 was to be formed, was roughened by blasting. After the blasting, the roughness of the roughened surface 43 was 2 μm in Ra, and 10 μm in Rz. The material for the parting layer 42, that is, mixture of PEEK, PFK, and electrical conductor, was coated on the roughened surface 43, and was sintered. Then, the surface of the pressing member 40, which was going to face the fixation roller 30, was buffed so that the substrate peaks became virtually equal in height. The area in FIG. 8, which is designated by a referential number 45, corresponds to the portions of the pressing member, which was buffed away. Since the pressing member 40 was manufactured with the use of the method described above, the substrate 41 and parting layer 42 were co-existent at the surface of the pressing member 40, which was going to face the fixation roller 30, even when the pressing member 40 was brand-new.

In this embodiment, the surface 43 of the substrate 41 of the pressing member 40 was roughened by shot-blasting. However, this embodiment is not intended to limit the present invention in terms of the method for roughening the surface of the substrate 41. The range in which the ratio in size between the parting layer 42 and the exposed portions of the peaks of the substrate 41 should be in order for the pressing member 40 in this embodiment to be effective is the same as that in the second embodiment. Further, it was by buffing that the surface of the pressing member 40 was polished. However, this embodiment is not intended to limit the present invention in terms of the method for polishing the pressing member 40.

In this embodiment, the peaks of the roughened surface of the substrate 41 of the pressing member were made uniform in height by buffing the surface of the pressing member 40, which was to face the fixation roller 30, after the completion of the sintering process. Thus, the parting layer 42 and the peaks of the roughened surface 43 of the substrate 40 were co-existent at the surface of the pressing member 40, which was going to face the fixation roller 30, even when the pressing member 40 was brand-new. Therefore, the problem that the nip portion of the pressing member 40 is frictionally worn by the conveyance of a sheet P of recording medium through the nip Nt was impeded from when the pressing member 40 was brand-new. Therefore, the pressing member 40 in this embodiment was significantly smaller than any conventional pressing member, in the amount by which the nip Nt changed in shape as the cumulative number by which sheets P of recording medium were conveyed through the nip Nt increased. Therefore, the pressing member 40 in this embodiment enabled a fixing device to properly convey sheets P of recording medium longer than any conventional pressing member.

In the preceding description of the preferred embodiments of the present invention, it was stated that the material for the parting layer formed on the roughened surface of the substrate of the pressing member is desired to be resinous. However, these embodiments are not intended to limit the present invention in terms of the material for the parting layer. For example, in order to impede the frictional wear of the nip portion of the surface of the pressing member, which is attributable to the repeated recording sheet conveyance through the fixation nip, the surface of the pressing member, which is going to face a fixation roller may be coated with a ceramic film formed of DLC, CrN, or a film formed of a metallic substance, which are low in frictional resistance and high in hardness.

However, these substances are not as good in parting properties as the resinous substance. Therefore, as a fixing device which has a pressing member, the substrate of which is formed of one of these substance, increases in the cumulative number of recording medium conveyance through its fixation nip, toner particles, paper dust, and the like contaminants are likely to adhere to, and collect on, the downstream portion of the pressing member, relative to the fixation nip, in terms of the recording medium conveyance direction, and soil the edges and/or backside of a sheet P of recording medium. Further, using one of these substances as the material for the surface layer of a pressing member makes the pressing member significantly higher in the frictional resistance between itself and a sheet P of recording medium, than one of the resinous substances listed before.

Thus, in a case where a fixation pad is made up of a substrate and a parting layer, and the surface of the substrate, on which the parting layer is formed, is roughened before the material for the parting layer is formed on the surface, a resinous substance is preferable as the material for the parting layer to a ceramic or metallic substance.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 217069/2010 filed Sep. 28, 2010 which is hereby incorporated by reference.

What is claimed is:

1. An image heating apparatus comprising:

a heating rotatable member;

a pad contacted to said heating rotatable member and cooperating with said heating rotatable member to form a nip portion for nipping and feeding a recording material, wherein said pad includes a base material having a roughened surface and a parting layer on the roughened surface, the parting layer being contacted to said heating rotatable member, and the roughened surface includes peaks, and an area of top surfaces of the peaks comprises less than 40% of an area of a plane intersecting the pad that includes the top surfaces of the peaks.

2. An apparatus according to claim 1, wherein a surface roughness of said base material satisfy 1 μm≤Ra≤15 μm and 3 μm≤Rz≤60 μm.

3. An apparatus according to claim 1, further comprising a heater contacting said surface of said heating rotatable member.

* * * * *